United States Patent [19]

Huh et al.

[11] Patent Number: 4,944,046

[45] Date of Patent: Jul. 31, 1990

[54] COVER SHEET APPARATUS FOR TOILET SEAT

[76] Inventors: Phil-yool Huh, 1-5-8, Nakamachi, Musashino-shi, Tokyo, Japan; Yoshihiro Sakurai, 2-4-10, Naki, Shinjuku-ku, Tokyo, Japan

[21] Appl. No.: 253,460

[22] Filed: Oct. 5, 1988

[30] Foreign Application Priority Data

Oct. 14, 1987 [JP] Japan ..... 62-257249

[51] Int. Cl.[5] ..... A47K 13/14

[52] U.S. Cl. ..... 4/243

[58] Field of Search ..... 4/242, 243

[56] References Cited

U.S. PATENT DOCUMENTS

| | | | |
|---|---|---|---|
| 1,396,547 | 11/1921 | Barsness | 4/243 |
| 1,961,704 | 6/1934 | Morton | 4/242 X |
| 2,712,654 | 7/1955 | Batlas et al. | 4/243 |
| 4,264,992 | 5/1981 | Tromp | 4/242 X |
| 4,297,750 | 11/1981 | Lutz | 4/242 X |

FOREIGN PATENT DOCUMENTS

| | | |
|---|---|---|
| 7024226 | 10/1970 | Fed. Rep. of Germany . |
| 2023875 | 11/1971 | Fed. Rep. of Germany . |
| 558889 | 9/1923 | France . |
| 983702 | 6/1951 | France . |
| 135443 | 9/1929 | Switzerland . |

*Primary Examiner*—Charles E. Phillips

*Attorney, Agent, or Firm*—Armstrong, Nikaido, Marmelstein, Kubovcik & Murray

[57] ABSTRACT

A cover sheet apparatus for a toilet seat comprising a case containing a stack of sheets of paper which are in engagement with each other at their mutually adjacent front and read ends and are always urged forwards by a spring. The case is attached to a rear portion of a toilet, and when a user pulls toward oneself a pull section of the foremost cover sheet of the stack, the sheet is taken out from the case in its original shape and size, and is laid, as it is, on a seat of the toilet. In conjunction with the pulling out of the foremost cover sheet, the next cover sheet adjacent thereto is pulled so that a pull section thereof peeps out at an outlet of the case to be ready for the next use. A cover plate can be provided on the case for covering the pull section of the foremost cover sheet at the outlet of the case, whereby the foremost cover sheet is prevented from being wetted with flushing water or urine.

5 Claims, 3 Drawing Sheets

COVER SHEET APPARATUS FOR TOILET SEAT

BACKGROUND OF THE INVENTION

This invention relates to a cover sheet apparatus used for a toilet seat, in which a stack of cover sheets are taken out one by one and each sheet after being taken out is laid on a toilet seat of a Western style toilet.

A known sheet for a toilet seat is a water soluble square sheet of paper big enough to cover a toilet seat of a Western style toilet. This known sheet has its center portion defined by a generally oval cut lines comprising right and left symmetrically curved cut lines leaving front and rear spaces therein made along the inner contour of an oval or circle-shaped toilet seat. Each cover sheet is folded longitudinally and laterally plural times in general, twice into four, so as to be reduced in size. A large number of the folded small-sized cover sheets are piled one upon another, and are contained in a container box to make a conventional apparatus used for a toilet seat.

It, however, is a disadvantage of the conventional apparatus that at each time of use thereof, each folded cover sheet is taken out from the box which has been placed on a position which is separate from the place where the toilet is situated, and is unfolded into the original large size and shape and is laid on a toilet seat. It is very troublesome and inconvenient to use.

OBJECT AND SUMMARY OF THE INVENTION

It is, therefore, a principal object of the present invention to provide a cover sheet apparatus for a toilet seat which can be attached to an existing toilet and in which a stack of cover sheets can be pulled out one by one so that each cover sheet as it is taken out is in its original size and shape so that it can be laid as it is on a toilet seat.

The first aspect of the present invention is characterized in that a case is provided which has one part thereof arranged to be opened and closed for a stack of cover sheets and is provided with an outlet at its lower front portion. The case is adapted to be mounted upright on a rear portion of a toilet seat. The stack of cover sheets comprises a plurality of cover sheets so folded and stacked in the front to rear direction in such a condition that a front part of a rear-positioned folded sheet in the stack may be engaged with a rear part of a front-positioned folded sheet therein. In this manner, the front part of the rear-positioned sheet can be automatically pulled out through the outlet when a front part of the front-positioned sheet is taken out of the case through the outlet. A pushing means is provided in the case which resiliently keeps on pushing the stack of cover sheets forward at all times.

The second aspect of the present invention is characterized in that a cover plate is mounted on the upper edge of the outlet of the case to be swingable upwardly and downwardly.

For an actual use of this invention apparatus, the case thereof is attached upright to the rear portion of a toilet by means of a securely fitting means and, in this condition, a front part of the foremost cover sheet of the stack of the cover sheets that appears is protruded out of the case. The foremost sheet is held at both side corners thereof and is pulled forward or toward oneself, so that the foremost sheet is taken out from the case in its original shape and size and readily laid on the upper surface of a toilet seat.

When the cover sheet has been taken out, the front part of the successive rear-positioned cover sheet is automatically protruded outside through the outlet of the case so as to be set ready for the next use. In this manner, cover sheets contained in the stacked condition in the case are taken out one after another while a stack thereof in the case is kept constantly urged forward by the resilient means.

In addition, according to the second aspect of the present invention, a front part of the foremost cover sheet protruded out of the case is covered by a cover plate, but the cover plate does not interfere with a user's pulling out the cover sheet and at the same time prevents the foremost cover sheet from being wetted with flushing water or stained with male urination.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
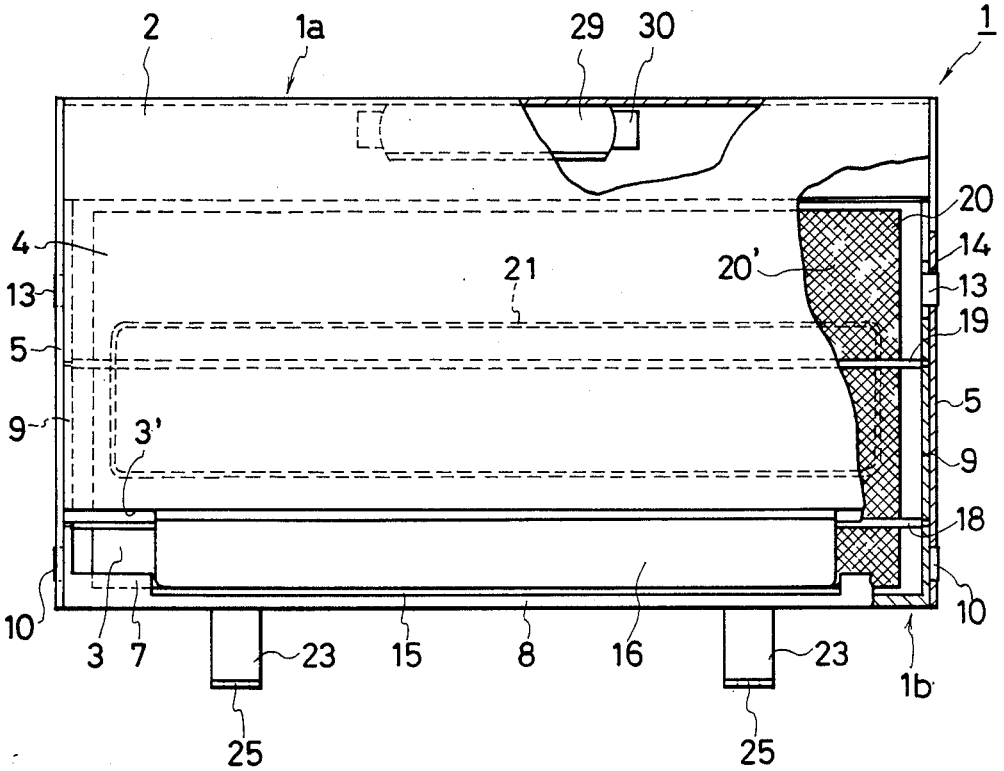
FIG. 1 is a partially cut-away, general front view of one embodiment of a cover sheet apparatus for a toilet seat according to the present invention.
Figure 2:
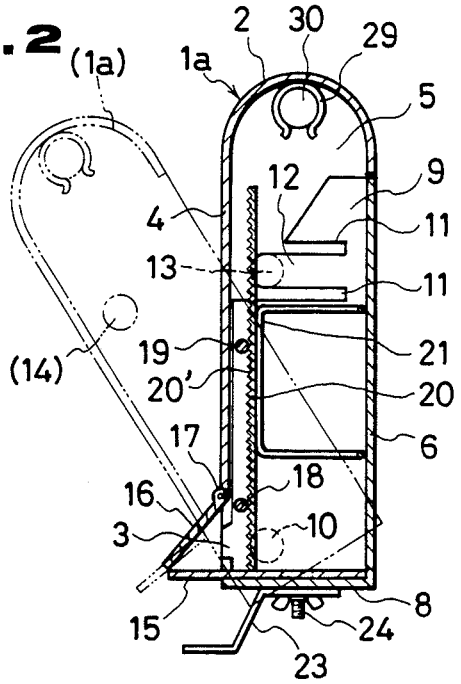
FIG. 2 is a general, longitudinal sectional view thereof.
Figure 3:
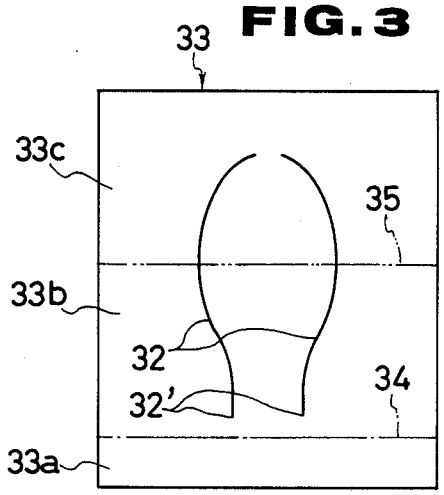
FIG. 3 is a plan view of a cover sheet.

A preferred embodiment of the present invention will now be described more in detail in the following with reference to the accompanying drawings. A cubic case 1 is long from side to side in the lateral direction and short from front to rear in depth direction and is formed of a synthetic resin molding. The case 1 is composed of a movable member 1*a* comprising a top portion 2 which is arch-shaped in a longitudinal sectional view thereof, an upright front plate 4 whose lower portion has a cut-away portion 3' extending in the widthwise direction and left and right outer side plates 5, and a fixed member 1*b* comprising a rear plate 6, a bottom plate 8 having a somewhat raised rib 7 at its front edge and left and right inner side plates 9 whose upper portions are obliquely cut away and which are located inside the left and right outer side plates 5, so that the lower portions of the outer and inner side plates 5 and 9 may be pivotally mounted on pivotal shaft pieces 10 on both the left and right sides. In this manner, the movable member 1*a* can be tilted forwardly and downwardly with respect to the fixed member 1*b*. Two cut grooves 11 are made in the upper portion of each of the left and right inner side plates 9 located one above the other and parallel to each other. A separation part 12 formed on each inner side plate between the two cut grooves 11 is provided at its forward end with an engaging piece 13, so that the top surface, the side surfaces and the front surfaces of the fixed member 1*b* may be all covered with the movable member 1*a* in ordinary condition by engagement of the engaging piece 13 with a engaging hole 14 made in the upper portion of each of the left and right outer side plates 5. A support plate 15 is attached to the inner surface of the bottom plate 8 of the fixed member 1*b* to project horizontally forward through a cutaway portion provided at the central portion of the raised rib 7. A cover plate 16 has its upper edge mounted pivotally on a shaft rod 17 extending along the upper edge of an outlet 3 formed between the lower-edge cutaway portion 3' of the front plate 4 and the support plate 15 attached to the bottom plate 8 so that it may be swingable thereabout upwards and downwards to close the outlet except for both side-end portions thereof. Also, the cover plate 16 is arranged so that its front edge may be brought into abutment with the front edge of the support plate 15. A rotary shaft rod 18 is mounted rotatably and widthwise between the left and right inner side plates 9, 9 in a location opposite to the upper edge of the outlet 3. A second rotary shaft rod 19 is located above the rotary shaft rod 18 parallel thereto and mounted rotatably and widthwise between the left and right inner side plates 9, 9. A push plate 20 is provided for pushing forward a stack of cover sheets that is to be described later. The push plate 20 is resiliently urged forward by a resilient member 21 which is formed in the shape of, for instance, an oblong having its long side widthwise and consists of a resilient frame of spring wire which is arched widthwise. The push plate 20 is square in the shape and preferably has its front surface 21' roughened with embossing or a frictional piece or the like. A metal fitting 23 bent into the shape of a stairway has the upper horizontal part thereof securely attached to the underside of the bottom plate through a fastening device 24 while the lower horizontal part thereof extending forwardly is provided with a mounting groove 25.

A pair of the metal fittings 23 are arranged to be positioned and spaced from each other so as to correspond with locations of a pair of left- and right-side screw shafts 28 provided on the rear upper surface of the toilet A at attaching portions 27 for mounting the toilet seat 26 so that the toilet seat 26 may be swingable upwards and downwards. Positioned as described above, they are securely fastened respectively at said left- and right-side locations to the underside of the bottom plate 8. For fastening the cover sheet apparatus to the toilet A, the screw shaft 28 is first loosened, the mounting groove 25 is so placed as to be properly in engagement with the screw shaft 28, and the screw shaft 28 is then tightened so that the metal fitting 23 is securely fastened in place, whereby the case 1 is mounted upright on the rear upper surface of the toilet A. A resilient holder 29 is provided inside the arched top portion of the case 1. This holder 29 holds therein a tubular container supplement 30 containing a deodorant, aromatic, etc.

Figure 4:
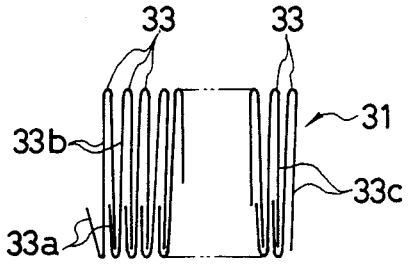
FIG. 4 is a side view of a stack of cover sheets according to the present invention.
Figure 5:
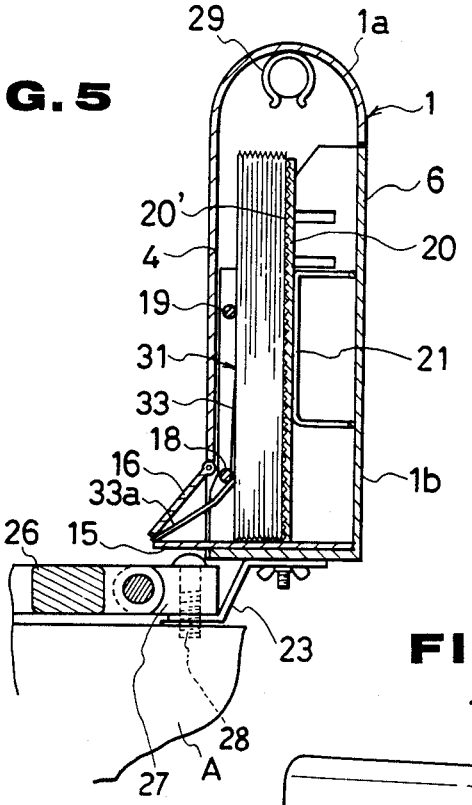
FIG. 5 is a longitudinal sectional view of the apparatus in use condition.

A stack 31 of cover sheets to be contained in the case 1 comprises a plurality of water-soluble sheets of paper, each sheet 33 thereof being square and big enough to cover the upper surface of the toilet seat 26. Each sheet 33 has right and left symmetrically curved cut lines 32 at its center area portion leaving front and rear spaces therebetween made along the inner contour of an oval or circle-shape of the toilet seat. Each sheet 33 is folded into three sections, namely, a pull section 33*a* which is a front-end portion of the sheet divided from the rest by an upper-folding line 34 located some distance away downwardly of the front ends 32' of the right and left cut lines 32, a front-side surface section 33*b* formed between the upward-folding line 34 and a downward-folding line 35 made along a center horizontal line between the rear edge sheet 33 and the upward-folding line 34, and a rear-side surface section 33*c* constituted by the remainder of the sheet. The stack 31 of successive cover sheets 33 is formed by stacking a plurality of these sheets 33 in a manner where the front edge of the rear-side surfaces section 33*c* of one sheet is inserted between the pull section 33*a* and the front-side surface section 33*b* of another one positioned immediately therebehind as shown in FIG. 4. The stack 31 of cover sheets arranged as above is contained in the case 1 located between the pair of upper and lower rotary shafts rods 18, 19 and the push plate 20. The pull section 33*a* of the foremost one of the sheets in the stack form may be protruded through the outlet and be held between the support plate 15 and the cover plate 16.

In this arrangement in which the stack 31 of cover sheets is contained in the case 1, the foremost sheet in the stack of cover sheets 31 is pulled outward oneself by holding, between one's fingers, both side portions of the pull section 33*a* thereof exposed at locations by both side ends of the cover plate 16 and pulling the sheet toward a user.

Figure 6:
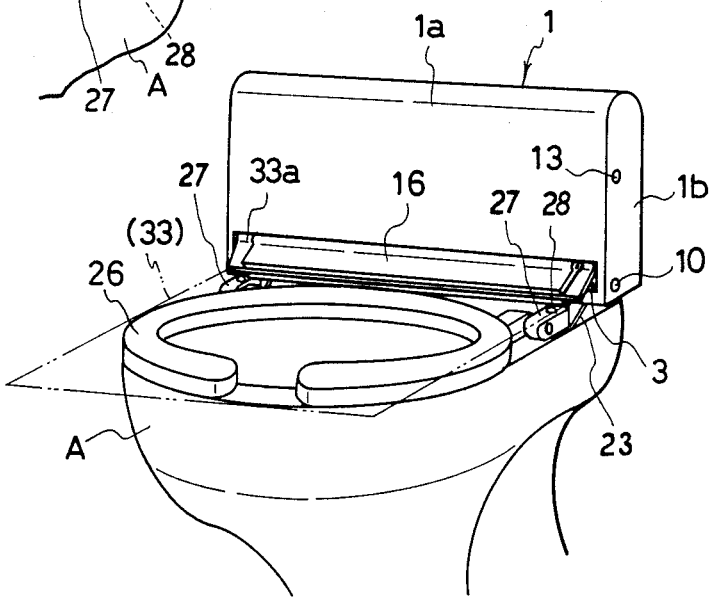
FIG. 6 is a perspective view of the apparatus in use condition.

When so pulled toward oneself, the whole of the sheet 33 can be taken out in its original shape and size and can be readily laid on the upper surface of the toilet seat as indicated by imaginary lines in FIG. 6.

On the other hand, in conjunction with pulling of the foremost sheet 33 as above, the pull section 33*a* of another or next sheet 33 can be automatically pulled out so as to peep out from between the support plate 15 and the cover plate 16, and thus made ready for next use.

In the foregoing arrangement, the stack of cover sheets 31 is always kept pushed forward by the push plate 20 urged forward by the resilient member 21 so that the stack of cover sheets may not fall flat or collapse no matter how few sheets are left in the stack. This ensures that each of the sheets in the stack is pulled out one by one up to the very last one without failure.

As described in the foregoing, according to the present invention, a plurality of cover sheets for a toilet seat are folded and arranged to form a stack thereof so that each sheet in the stack may be held upright when contained in the case. This enables a large number of cover sheets to be contained in a case having a small depth dimension. The case can be easily erected by utilizing a small space on the rear part of a toilet simply by metal fittings. In addition, each sheet of the stack is easily taken out and readily spread on the toilet seat as it is in the original shape and size by simply pulling the pull section thereof toward oneself, so that it is very convenient to use. This makes one of the advantages of the present invention.

Further, according to the second aspect of the present invention, a cover plate is additionally provided to cover the pull section of the sheet so that the sheet can be prevented from being wetted with flushing water and urine. This is another advantage of the present invention.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A cover sheet apparatus for a toilet seat comprising a case having one part thereof arranged to be opened and closed for containing a stack of cover sheets, a fixed member, and an outlet at its lower front portion, said one part of the case including a movable member comprising a top portion having an arch shape in longitudinal section, a front plate having a lower portion with a cutaway portion extending along the widthwise direction, and left and right outer side plates, said case being mounted upright on a rear portion of a toilet, said stack of cover sheets comprising a plurality of cover sheets folded and stacked in a depth direction with a front-positioned cover sheet and a rear-positioned cover sheet in engagement with each other whereby when the front-positioned cover sheet is pulled and taken out of the case through the outlet, the next rear-positioned cover sheet is automatically pulled out through the outlet, a pushing means in said case for resiliently pushing the stack of cover sheets forward at all times, and a pair of horizontal, parallel rotary shafts rotatably mounted in said case forwardly of said pushing means and in engagement with said front-positioned cover sheet so as to ease pulling out of said front-positioned cover sheet.

2. A cover sheet apparatus for a toilet seat according to claim 1, wherein said fixed member comprises a rear plate, a bottom plate and left and right inner side plates, said movable member being connected to said fixed member so as to be forwardly and rearwardly pivotal.

3. A cover sheet apparatus for a toilet seat according to claim 1 or 2, wherein the pushing means comprises a resilient member and a push plate urged forward by said resilient member, said push plate having a roughened front surface.

4. A cover sheet apparatus for a toilet seat according to claim 1, further comprising a cover plate mounted on the upper edge of the outlet of the case swingable upwardly and downwardly.

5. A cover sheet apparatus for a toilet seat according to claim 4, wherein the cover plate is sized such that portions of said outlet beyond both left and right ends of the cover plate remain exposed.

* * * * *